US010018445B2

(12) United States Patent
Fesas

(10) Patent No.: US 10,018,445 B2
(45) Date of Patent: Jul. 10, 2018

(54) FIREARM WITH HANDGUARD

(71) Applicant: Nelson A. Fesas, Austin, TX (US)

(72) Inventor: Nelson A. Fesas, Austin, TX (US)

( * ) Notice: Subject to any disclaimer, the term of this patent is extended or adjusted under 35 U.S.C. 154(b) by 0 days.

(21) Appl. No.: 14/975,832

(22) Filed: Dec. 20, 2015

(65) Prior Publication Data

US 2017/0176135 A1 Jun. 22, 2017

(51) Int. Cl.
*F41C 23/00* (2006.01)
*F41C 23/16* (2006.01)
*F41A 13/00* (2006.01)

(52) U.S. Cl.
CPC ..... *F41C 23/16* (2013.01); *F41A 13/00* (2013.01)

(58) Field of Classification Search
CPC ..... F41C 23/16; F41A 13/00
USPC ..... 42/71.01
See application file for complete search history.

(56) References Cited

U.S. PATENT DOCUMENTS 5,198,600 A * 3/1993 E'Nama ..... F41C 27/00 42/105
5,343,650 A * 9/1994 Swan ..... F41C 23/16 42/117
5,590,484 A * 1/1997 Mooney ..... F41G 1/16 42/111
6,381,895 B1 * 5/2002 Keeney ..... F41G 11/003 42/111
6,499,245 B1 * 12/2002 Swan ..... F41C 23/00 42/124
6,671,990 B1 * 1/2004 Booth ..... F41C 23/16 42/75.01
6,694,660 B1 * 2/2004 Davies ..... F41A 21/482 42/71.01
7,059,076 B2 * 6/2006 Stoner ..... F41G 11/003 42/75.01
7,131,228 B2 * 11/2006 Hochstrate ..... F41C 23/16 42/75.01
RE39,465 E * 1/2007 Swan ..... 42/124
7,216,451 B1 * 5/2007 Troy ..... F41C 23/16 42/71.01
RE40,216 E * 4/2008 Swan ..... F41C 23/00 42/124
7,574,823 B2 * 8/2009 Nakayama ..... F41A 21/481 42/75.01
7,707,762 B1 * 5/2010 Swan ..... F41C 23/16 42/105
7,716,865 B2 * 5/2010 Daniel ..... F41C 23/16 42/75.01

(Continued)

*Primary Examiner* — Michelle R Clement
(74) *Attorney, Agent, or Firm* — Gregory K. Goshorn; Greg Goshorn, P.C.

(57) ABSTRACT

Provided is a firearm, comprising a receiver; a barrel; an upper handguard, a lower handguard, an upper barrel clamp and a lower barrel clamp, configured to be affixed to the receiver, wherein the upper barrel clamp and the lower barrel clamp are configured to be fastened together, affixing the upper barrel clamp and the lower barrel clamp to the barrel at a back-end of barrel; and wherein the upper handguard and lower handguard slide onto and are configured to be affixed to the upper barrel clamp and the lower barrel clamp, thus affixing the upper handguard and the lower handguard to both the barrel and the receiver such that the upper and lower handguards attach to the barrel solely at the back-end of the barrel.

10 Claims, 6 Drawing Sheets

(56) References Cited

U.S. PATENT DOCUMENTS 7,770,317 B1 * 8/2010 Tankersley ..... F41C 23/16 42/71.01
7,793,452 B1 * 9/2010 Samson ..... F41C 23/16 42/71.01
7,802,392 B2 * 9/2010 Peterson ..... F41A 11/02 42/124
7,905,041 B1 * 3/2011 Davies ..... F41A 3/66 42/75.02
7,938,055 B2 * 5/2011 Hochstrate ..... F41A 3/66 42/127
7,941,959 B1 * 5/2011 Swan ..... F41C 23/16 42/105
8,051,595 B2 * 11/2011 Hochstrate ..... F41A 5/18 42/75.01
8,069,604 B2 * 12/2011 Larue ..... F41A 21/482 42/75.1
8,141,289 B2 * 3/2012 Gomez ..... F41C 23/16 42/90
8,201,353 B1 * 6/2012 Swan ..... F41C 23/16 42/71.01
8,276,304 B2 * 10/2012 Samson ..... F41C 23/16 42/112
8,347,540 B2 * 1/2013 Sirois ..... F41C 23/16 42/71.01
8,448,367 B2 * 5/2013 Samson ..... F41A 13/12 42/75.02
8,464,457 B2 * 6/2013 Troy ..... F41C 23/16 42/71.01
8,578,642 B2 * 11/2013 Troy ..... F41C 23/16 42/71.01
8,607,490 B1 * 12/2013 Zinsner ..... F41C 23/16 42/71.01
8,640,372 B2 * 2/2014 Hochstrate ..... F41A 5/18 42/111
8,689,477 B2 * 4/2014 Gomez ..... F41C 23/16 42/72
8,739,448 B2 * 6/2014 Kimmel ..... F41C 23/16 42/124
8,789,304 B2 * 7/2014 Engesser ..... F41A 21/481 42/75.01
8,806,793 B2 * 8/2014 Daniel ..... F41C 23/16 42/72
8,844,186 B2 * 9/2014 Leclair ..... F41C 23/16 42/71.01
8,863,426 B1 * 10/2014 Zinsner ..... F41C 23/16 42/71.01
8,904,691 B1 * 12/2014 Kincel ..... F41C 23/16 42/71.01
9,003,686 B2 * 4/2015 Brown ..... F41C 23/16 42/75.01
9,140,506 B2 * 9/2015 Gomez ..... F41A 21/487
9,212,865 B2 * 12/2015 Dubreuil ..... F41C 23/16
9,335,117 B2 * 5/2016 Miller ..... F41C 23/16
9,518,801 B2 * 12/2016 Krebs ..... F41C 23/16
9,528,793 B1 * 12/2016 Oglesby ..... F41C 23/16
2006/0260169 A1 * 11/2006 Samson ..... F41C 23/16 42/72
2007/0033851 A1 * 2/2007 Hochstrate ..... F41A 5/18 42/75.01
2007/0199435 A1 * 8/2007 Hochstrate ..... F41A 3/66 89/191.02
2007/0261285 A1 * 11/2007 Troy ..... F41C 23/16 42/75.03
2008/0168695 A1 * 7/2008 Nakayama ..... F41A 21/481 42/75.02
2009/0288324 A1 * 11/2009 Peterson ..... F41A 11/02 42/75.03
2010/0095575 A1 * 4/2010 Swan ..... F41G 11/003 42/72
2010/0126054 A1 * 5/2010 Daniel ..... F41C 23/16 42/71.01
2010/0192444 A1 * 8/2010 Cabahug ..... F41G 11/003 42/71.02
2010/0212201 A1 * 8/2010 Kincel ..... F41G 11/003 42/2
2010/0269392 A1 * 10/2010 Swan ..... F41C 23/16 42/71.01
2010/0300277 A1 * 12/2010 Hochstrate ..... F41A 3/66 89/179
2010/0319231 A1 * 12/2010 Stone ..... F41C 23/16 42/71.01
2011/0000119 A1 * 1/2011 Desomma ..... F41A 3/66 42/75.02
2011/0016762 A1 * 1/2011 Davies ..... F41A 21/487 42/75.01
2011/0061281 A1 * 3/2011 Kapusta ..... F41C 23/16 42/71.01
2011/0126443 A1 * 6/2011 Sirois ..... F41C 23/16 42/90
2011/0192066 A1 * 8/2011 Kimmel ..... F41C 23/16 42/71.01
2011/0214327 A1 * 9/2011 Desomma ..... F41A 3/66 42/75.02
2011/0239513 A1 * 10/2011 Sandman ..... F41C 23/16 42/90
2011/0247254 A1 * 10/2011 Barnes ..... F41A 21/48 42/71.01
2012/0111183 A1 * 5/2012 Hochstrate ..... F41A 5/18 89/193
2012/0124880 A1 * 5/2012 Leclair ..... F41A 21/484 42/71.01
2012/0216439 A1 * 8/2012 Barrett ..... F41A 3/26 42/75.02
2012/0246989 A1 * 10/2012 Troy ..... F41C 23/16 42/71.01
2012/0297970 A1 * 11/2012 Langevin ..... F41C 23/16 89/125
2012/0317859 A1 * 12/2012 Brown ..... F41A 3/66 42/71.01
2012/0324775 A1 * 12/2012 Troy ..... F41C 23/16 42/71.01
2013/0019513 A1 * 1/2013 Telles ..... F41C 23/16 42/94
2013/0055613 A1 * 3/2013 Gomez ..... F41C 23/16 42/90
2013/0097910 A1 * 4/2013 Daniel ..... F41C 23/16 42/72
2013/0205634 A1 * 8/2013 Langevin ..... F41C 23/16 42/71.01
2013/0276341 A1 * 10/2013 Wells ..... F41G 11/003 42/71.01
2014/0075804 A1 * 3/2014 Langevin ..... F41C 23/16 42/16
2014/0076146 A1 * 3/2014 Gomez ..... F41A 21/487 89/191.01
2014/0224113 A1 * 8/2014 Brown ..... F41A 5/18 89/193
2015/0135576 A1 * 5/2015 Wells ..... F41C 23/16 42/90
2015/0316347 A1 * 11/2015 Shea ..... F41C 23/16 42/75.02
2016/0138880 A1 * 5/2016 Stone ..... F41A 9/41 89/33.1
2016/0178316 A1 * 6/2016 Miller ..... F16B 39/04 29/456
2017/0023329 A1 * 1/2017 Gottzmann ..... F41C 23/16
2017/0067717 A1 * 3/2017 Krebs ..... F41C 23/16

* cited by examiner

FIREARM WITH HANDGUARD

FIELD OF THE DISCLOSURE

The present subject matter relates to the field of firearms and an integration means, and more particularly to hand guard that is angularly adjustable relative to the firearm receiver and barrel.

BACKGROUND

A constant goal for firearms operators is to improve the accuracy of their firearms. Handguards may be provided that enable a user to hold a firearm without touching the barrel, which may become too hot to handle when the firearm is used. Current handguards attach to a barrel at two points, i.e., at both the front and back of the handguard. This configuration prevents the barrel from "free-floating," which affects the accuracy of the firearm. A handguard attached at two points may cause a difference in the rate at which a handguard and the barrel heat resulting in a deflection of the barrel. In addition, any pressure applied to the handguard, such as bracing the handguard with a strap or against another object, may deflect the barrel. Further, a barrel has a natural frequency that may be affected by a handguard, causing the barrel to vibrate inconsistently and therefore affecting a bullet's trajectory.

SUMMARY

The claimed subject matter, while generally applicable to firearms and not limited in scope to any single type of firearm, for purposes of description will be herein described as relating to an AK-47 type rifle. The design of the AK-47 type rifle is intended for reliability, simplicity, and ease of manufacture. The configuration of an AK-47 type rifle includes easy to disassemble components for field stripping, cleaning, and maintenance.

Provided is a firearm, comprising a receiver, a barrel, an upper handguard, a lower handguard, an upper barrel clamp and a lower barrel clamp, configured to be affixed to the receiver, wherein the upper barrel clamp and the lower barrel clamp are configured to be fastened together, affixing the upper barrel clamp and the lower barrel clamp to the barrel at a back-end of barrel; and wherein the upper handguard and lower handguard slide onto and are configured to be affixed to the upper barrel clamp and the lower barrel clamp, thus affixing the upper handguard and the lower handguard to both the barrel and the receiver such that the upper and lower handguards attach to the barrel solely at the back-end of the barrel.

This summary is not intended as a comprehensive description of the claimed subject matter but, rather, is intended to provide a brief overview of some of the functionality associated therewith. Other functionality, features and advantages of the claimed subject matter will be or will become apparent to one with skill in the art upon examination of the following figures and detailed description.

BRIEF DESCRIPTION OF THE DRAWINGS

A better understanding of the claimed subject matter can be obtained when the following detailed description of the disclosed embodiments is considered in conjunction with the following figures.

DETAILED DESCRIPTION

The claimed subject matter, while generally applicable to firearms and not limited in scope to any single type of firearm, for purposes of description ill be herein described as relating to an AK-47 type rifle. Numerous configurations of the AK-47 type rifle are commercially available throughout the world. The typical AK-47 type rifle is well known and will not be described in substantial detail herein and will be hereinafter referred to as a rifle.

Figure 1:
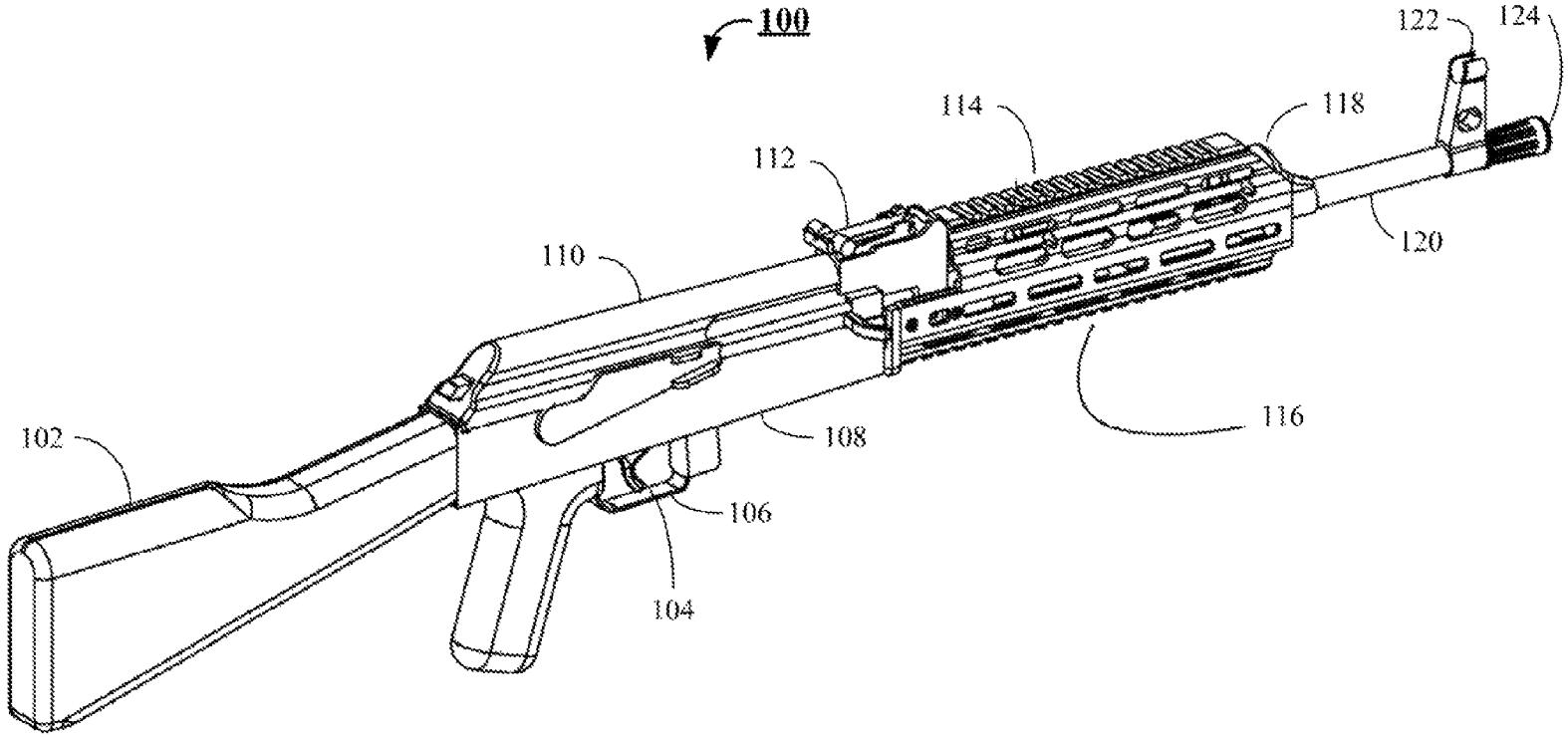
FIG. 1 is an illustration of an AK-47 type rifle with a handguard configured in accordance with the claimed subject matter.

Turning now to the figures. FIG. 1 is an illustration of an AK-47 type rifle 100 with a handguard configured in accordance with the claimed subject matter. The various components of rifle 100 include a buttstock 102, a trigger 104 a trigger guard 106, a receiver 108, a receiver cover 110, a rear sight 112, an upper hand guard 114, a lower hand guard 116, a gas block 118, a barrel 120, a front sight 122 and a muzzle 124. Components 102, 104, 106, 108, 110, 112, 114, 116, 118, 120, 122, 124 and 126 are used as examples throughout the Specification and FIGS. 2-9. It should be understood that rifle 100 also includes many other components but only some are illustrated for the sake of simplicity. In addition, some components that are obscured in this illustration are revealed in subsequent figures. Throughout the Specification the end of rifle 100 at barrel 120 is referred to as the "front" or "muzzle-end" of rifle 100 and the end at buttstock 102 is referred to as the "back-end" or "butt-end" of rifle 100.

Figure 2:
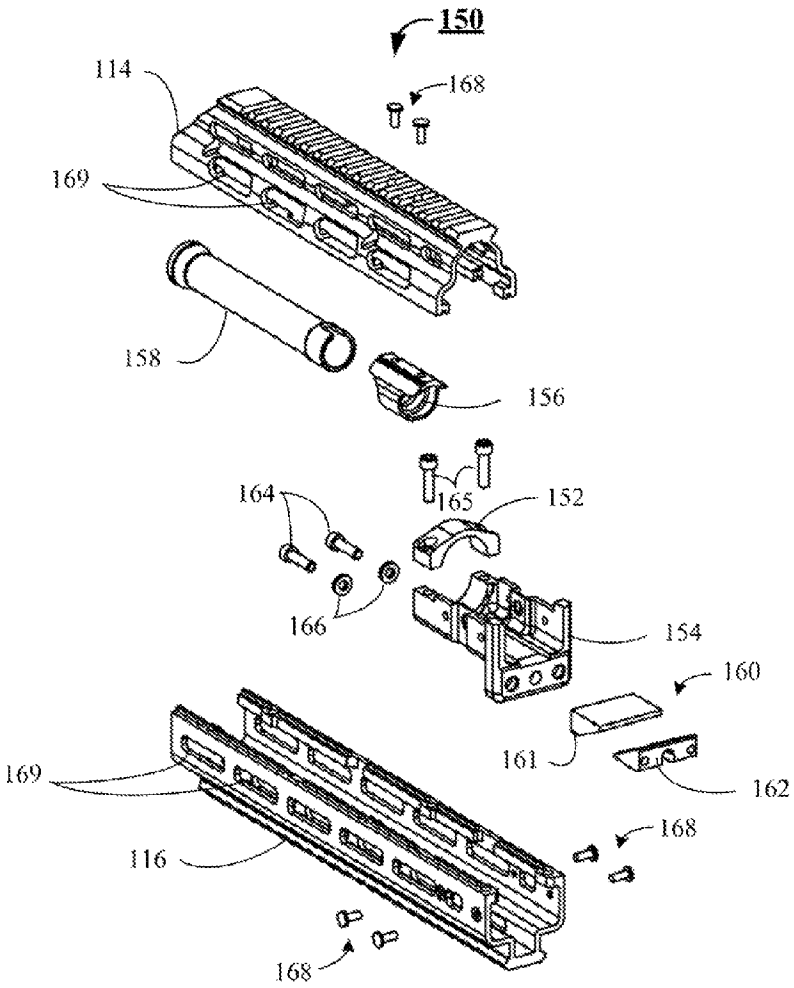
FIG. 2 is an illustration of a handguard, first introduced in FIG. 1 including both an upper and lower handguard configured in accordance with the claimed subject matter.

FIG. 2 is an illustration of a handguard 150, including both upper handguard 114 and lower handguard 116, both first introduced in conjunction with FIG. 1, configured in accordance with the claimed subject matter. FIG. 2 includes an upper barrel clamp 152 and a lower barrel clamp 154 and guide tube support 156 for a supporting guide tube 158. A wedge clamp 160 that includes a floating wedge 161 and a draw wedge 162 are also illustrated. Wedge clamp 160, floating wedge 161 and draw wedge 162 including their use and configuration, are described in more detail below in conjunction with FIGS. 3-9.

Components for the assembly of handguard 150 are also illustrated, including various bolts 164 and 165, washers 166 and rivets 168. The use and configuration of bolts 164 and 165, washers 166 and rivets 168 should be familiar to those with skill in the relevant arts. Also included in FIG. 2 are ventilation holes 169 in both upper handguard 114 and lower handguard 116. Although ventilation holes 169 are shown along both sides and the length of both upper handguard 114 and lower handguard 116 only four (4) are labeled for the sake of simplicity. It should be understood that the orientation of the elements of FIG. 2 are reversed from the orientation of rifle 100 (FIG. 1) of FIG. 1. In other words, the end of handguard 150 with wedges 161 and 162 would be facing the back, or back-end, of rifle 100.

Several features of FIG. 2 provide advantages over a typically configured rifle, as explained in more detail below. Briefly, since handguard 150 is attached to barrel 120 by upper barrel clamp 152 and lower barrel clamp 154, which are situated further from muzzle 124 than typical handguard clamps, handguard 150 does not heat as much as a typical handguard while rifle 100 is in operation. It should be understood that the barrel of a rifle heats up faster at the muzzle-end because fired bullets are traveling fastest in barrel 120 at that point and thus create more friction heat. Ventilation holes 169 also provide a cooling effect on handguard 150. In addition, guide tube support 156 is loosely coupled to guide tube 158 so that guide tube 158 and gas block 118 (FIG. 1), into which guide tube 158 fits, neither exert any significant force on barrel 120 nor conduct significant heat to handguard 150. Further, the fact that clamps 152 and 154 are situated further from muzzle 124 than typical clamps, optimizes barrel float for an improvement in the accuracy of rifle 100. A sling socket (not shown) may be attached to lower handguard 116 to enable a strap to be attached to handguard 150 rather than gas block 118, which also improves barrel float and prevents pressure on a sling (not shown) from exerting pressure on barrel 120. Other features are explained below in conjunction with FIGS. 3-9.

Figure 3:
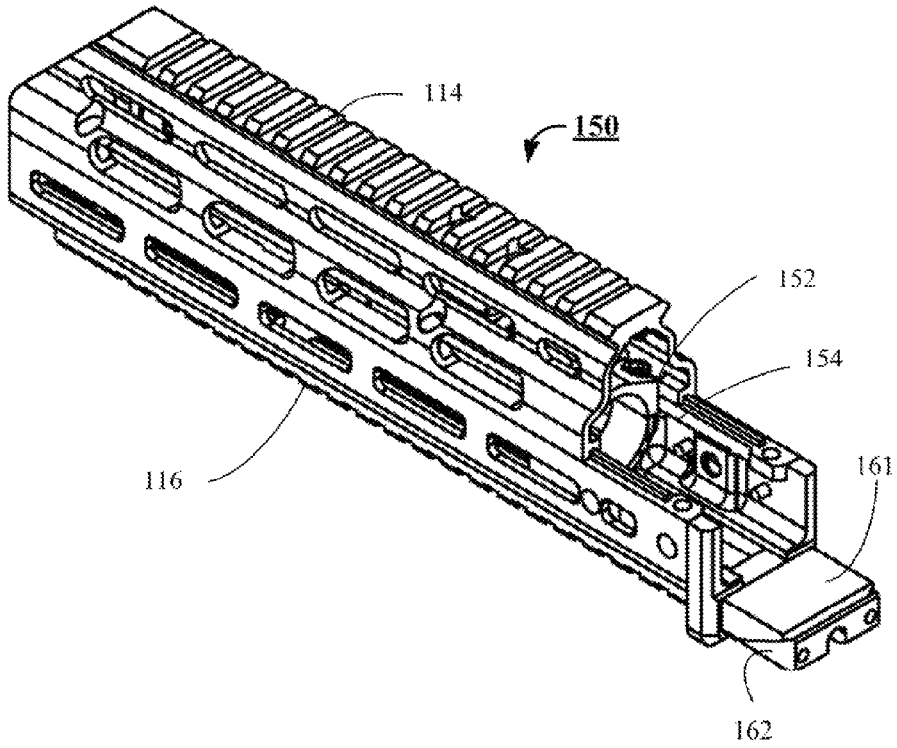
FIGS. 3 and 4 are illustrations of the upper and lower handguards of FIG. 2, assembled from two (2) different perspectives.
Figure 4:
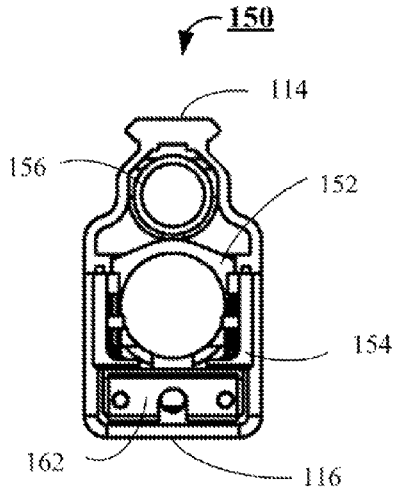

FIGS. 3 and 4 are illustrations of upper hand guard 114 and lower handguard 116 of FIG. 2, assembled into handguard 150 (FIGS. 1 and 2) from two (2) different perspectives. The orientation of handguard 150 in FIG. 3 is the same as the orientation in FIG. 2, showing handguard 150 from a perspective of the side and back. The orientation of handguard in FIG. 4 is from the bark-end of rifle 100 (FIG. 1). Also included in FIGS. 3 and 4 are upper clamp 152, lower clamp 154 and wedges 161 and 162, illustrated in relation to handguard 150 and each other. In addition, upper barrel clamp 152 and lower barrel clamp 154 are shown affixed to handguard 150. When handguard 150 is slid into place, lower barrel clamp 154 and upper barrel clamp 152 are clamped around barrel 120 (FIG. 1). Floating wedge 161 and draw wedge 162 are slid into place in receiver 108 (FIG. 1) and affixed therein such that handguard 150 becomes affixed to both barrel 120 and receiver 108.

FIG. 4 also shows the position of guide tube support 156 within upper handguard 114. Although not shown in FIG. 4, guide tube 158 fits into, and is loosely coupled to guide tube support 156. Guide tube support 156, guide tube 158, gas block 118, a bolt carrier (not shown) and an operating rod with a piston (not shown), which pass through guide tube 158, are typically referred to as a bolt carrier assembly. The use and makeup of a typical bolt carrier assembly should be familiar to those with skill in the relevant arts. The manner in which clamps 152 and 154 are affixed to barrel 120 and handguard 150 is affixed to clamps 152 and 154 is explained in more detail below in conjunction with FIGS. 8-9.

Figure 5:
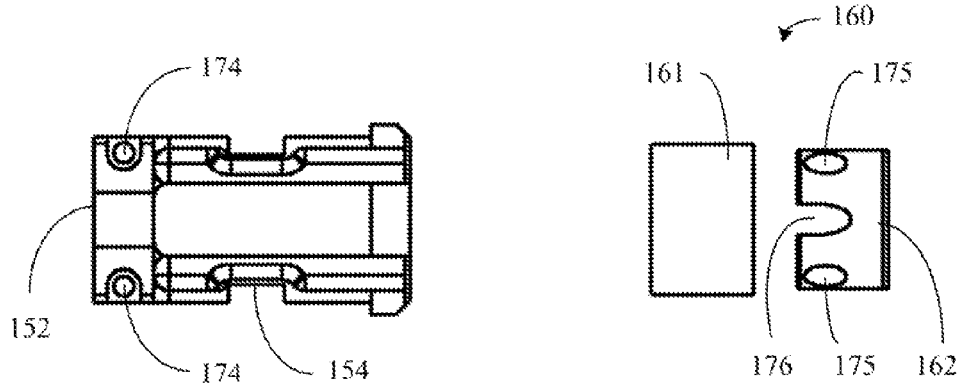
FIGS. 5-7 are illustrations of a wedge clamp comprised of a floating wedge and a draw wedge in conjunction with a lower barrel clamp and an upper barrel clamp, all of which were shown in FIGS. 2, 3 and 4.
Figure 6:
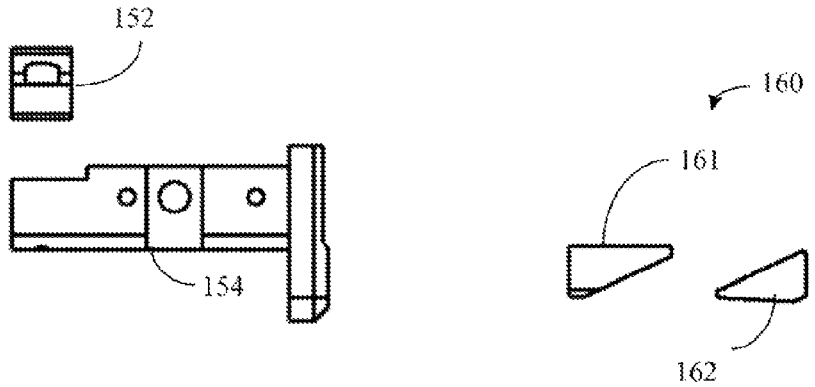
Figure 7:
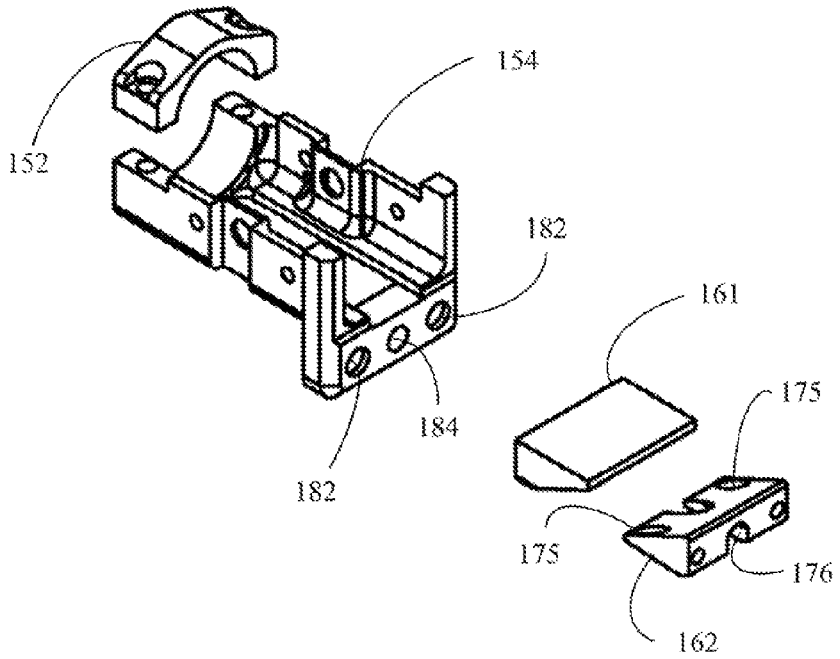

FIGS. 5-7 are illustrations of floating wedge 161 and draw wedge 162 in conjunction with upper barrel clamp 152 and lower barrel clamp 154, all of which are described in conjunction with FIGS. 2, 3 and 4, from different perspectives. FIG. 5 shows clamps 152 and 154 and wedges 161 and 162 from the top. FIG. 6 shows clamps 152 and 154 and wedges 161 and 162 from the back-end of rifle 100. FIG. 7 shows clamps 152 and 154 and wedges 161 and 162 from a side and top perspective.

Also visible in FIG. 5 are two holes 174 in upper barrel clamp 152. Corresponding threaded holes (not shown) in lower barrel clamp 154 enable bolts 165 (FIG. 2) to secure upper barrel clamp 152 to lower barrel clamp 154, pinching barrel 120 between clamps 152 and 154, thereby securing the assembled clamps to barrel 120.

In FIGS. 5 and 6, draw wedge 162 is illustrated with two threaded holes 175 and a channel 176. Bolts 164 (FIG. 2) pass through corresponding holes 182 in lower barrel clamp 154 and corresponding holes (not shown) in wedge 161, visible in FIG. 7, and are threaded into holes 175 in wedge 162 thus drawing wedges 161 and 162 together and causing expansion of wedges 161 and 162 within receiver 108. Relative radial and axial movement between lower barrel clamp 154, wedges 161 and 162 and around barrel 120 enable handguard 150 to be correctly positioned with respect to receiver. Channel 176, a corresponding hole 184, visible in FIG. 7, in lower clamp 154, provide an opening (not shown) in receiver 108 into which an accessory, such as but not limited to a cleaning rod (not shown), may be stored. As illustrated in FIGS. 3 and 4, handguard 150 slides onto upper barrel clamp 152 and lower barrel clamp 154 such that, when upper barrel clamp 152 and lower barrel clamp 154 are secured to barrel 120 and lower barrel clamp 154 is secured to receiver 108 by wedges 161 and 162, handguard 150 is secured to both barrel 120 and receiver 108.

Figure 8:
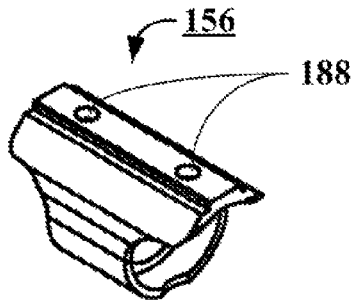
FIG. 8 is an illustration of a guide tube support, first introduced in FIG. 2, in greater detail.

FIG. 8 is an illustration of guide tube support 156, first introduced in FIG. 2, in greater detail. FIG. 8 shows guide tube support 156 from a side perspective. Two holes 188 are used to attach guide tube support 156 to upper hand guard 114 (FIGS. 1-4), typically with rivets, screws or any other suitable attachment mechanism (not shown).

Figure 9:
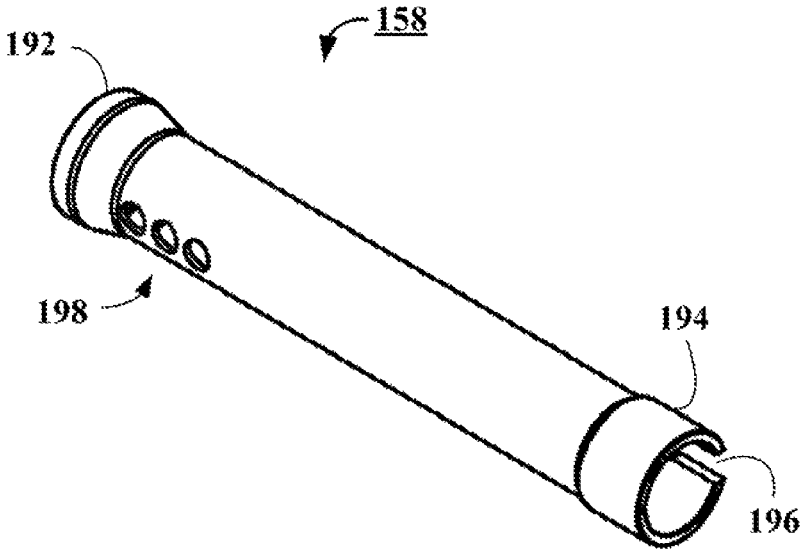
FIG. 9 is an illustration of a guide tube, first introduced in FIG. 2, in greater detail.

FIG. 9 is an illustration of guide tube 158, first introduced in FIG. 2, in greater detail. Guide tube 158 includes a muzzle or front end 192, which fits onto gas block 118 (FIG. 1) and a back end 194 that fits into guide tube support 156 (FIGS. 2 and 8). A slot 196 in back end 194 of guide tube 158 serves to align guide tube 158 onto rivets or other attachment mechanisms (not shown) through one of holes 188 that hold the guide tube support 156 onto upper hand guard 114. The alignment of slot 196 prevents guide tube 158 from rotating, within hand guard 150 (FIG. 24). Guide tube 158 also includes vent holes 198, which direct hot gas vented by gas block 118 onto barrel 120 (FIG. 1). The heat of the hot gas is thus dispersed by barrel 120 over a broad area. In this manner, the hot gas is prevented from blowing directly onto handguard 150, enabling handguard 150 to remain cooler than otherwise.

Guide tube support 156 is configured so that guide tube 158 (FIG. 2) may "float" inside guide tube support 156. In other words, guide tube support 156 provides support for guide tube 158 and sealing guide tube 158 within guide tube support 156 without unduly restricting the ability of guide tube 158 to have small movements thus mitigating any deflection of barrel 120 (FIG. 1) of rifle 100 (FIG. 1) by pressure on handguard 150. In addition, guide tube 158 is able to have a small amount of back and forth movement in guide tube support 156 due to the loose coupling, while still able to guide an operating rod assembly (not shown).

Other embodiments of the subject matter may be readily devised by those skilled in the art which will embody the principles of the subject matter and fall within the spirit and scope thereof it is to be understood that the subject matter is not limited to the specific features; shown and described since the means herein disclosed comprise only some of the forms of putting the subject matter into effect. The above detailed description constitutes only some of the preferred embodiments. The subject matter is, therefore, claimed in any of its forms or modifications within the proper scope of the claims.

I claim:

1. A firearm, comprising:

a receiver;

a barrel; and a handguard;

an upper barrel clamp;

a lower barrel clamp, configured to be affixed to the receiver;

a first plurality of holes in the lower barrel clamp; and a wedge clamp configured to affix the handguard to the barrel and the receiver, the wedge clamp comprising:

a draw wedge, the draw wedge comprising a second plurality of holes, each hole of the second plurality of holes having a corresponding hole in the first plurality of holes; and a floating wedge, the floating wedge comprising a third plurality of holes, each hole of the third plurality of holes with a corresponding hole in the first and second plurality of holes;

a plurality of fasteners corresponding to the first, second and third plurality of holes such that each fastener passes through corresponding holes in the first, second and third plurality of holes to affix the lower barrel clamp, the draw wedge and the floating wedge to the receiver such that the wedge clamp expands within the receiver;

wherein the upper barrel clamp and the lower barrel clamp are configured to be fastened together, affixing the upper barrel clamp and the lower barrel clamp to the barrel at a back-end of the barrel.

2. The firearm of claim 1, further comprising:

a guide tube; and a guide tube support affixed to the handguard, configured such that the guide tube is supported in and sealed with respect to the guide tube support without restricting small movements of the guide tube within the guide tube support.

3. The firearm of claim 2, the firearm further comprising a gas block and the guide tube further comprising:

an alignment slot configured to prevent the guide tube from rotating with respect to the handguard; and a plurality of venting holes configured such that hot gas from the gas block is directed towards the barrel and away from the handguard.

4. The firearm of claim 1, the handguard further comprising a plurality of ventilation holes.

5. The firearm of claim 1, wherein the firearm is a rifle.

6. A apparatus for holding a firearm, comprising:

a handguard;

an upper barrel clamp; and a lower barrel clamp, configured to be affixed to a receiver of the firearm, a first plurality of holes in the lower barrel clamp; and a wedge clamp configured to affix the handguard to a barrel of the firearm and the receiver, the wedge clamp comprising:

a draw wedge, the draw wedge comprising a second plurality of holes, each hole of the second plurality of holes having a corresponding hole in the first plurality of holes; and a floating wedge, the floating wedge comprising a third plurality of holes, each hole of the third plurality of holes with a corresponding hole in the first and second plurality of holes;

a plurality of fasteners corresponding to the first, second and third plurality of holes such that each fastener passes through corresponding holes in the first, second and third plurality of holes to affix the lower barrel clamp, the draw wedge and the floating wedge to the receiver such that the wedge clamp expands within the receiver;

wherein the upper barrel clamp and the lower barrel clamp are configured to be fastened together, affixing the upper barrel clamp and the lower barrel clamp to the barrel of the firearm at a back-end of the barrel.

7. The apparatus of claim 6, further comprising:

a guide tube; and a guide tube support affixed to the handguard, configured such that the guide tube is supported in and sealed with respect to the guide tube support without restricting small movements of the guide tube within the guide tube support.

8. The apparatus of claim 7, the firearm further comprising a gas block and the guide tube further comprising:

an alignment slot configured to prevent the guide tube from rotating with respect to the handguard; and a plurality of venting holes configured such that hot gas from the gas block is directed towards the barrel and away from the handguard.

9. The apparatus of claim 6, the handguard further comprising a plurality of ventilation holes.

10. The apparatus of claim 6, wherein the apparatus is configured to be employed with a rifle.

* * * * *